US007836721B2

(12) United States Patent
Nishiwaki et al.

(10) Patent No.: US 7,836,721 B2
(45) Date of Patent: Nov. 23, 2010

(54) COOLING SYSTEM

(75) Inventors: Yoshinori Nishiwaki, Kumamoto (JP); Tsuneo Nakama, Kumamoto (JP); Shigeru Sakashita, Tokyo (JP)

(73) Assignee: Suntory Holdings Limited, Osaka-shi, Osaka (JP)

( * ) Notice: Subject to any disclaimer, the term of this patent is extended or adjusted under 35 U.S.C. 154(b) by 255 days.

(21) Appl. No.: 11/632,650

(22) PCT Filed: Jul. 14, 2005

(86) PCT No.: PCT/JP2005/013429

§ 371 (c)(1),
(2), (4) Date: Jan. 16, 2007

(87) PCT Pub. No.: WO2006/009231

PCT Pub. Date: Jan. 26, 2006

(65) Prior Publication Data

US 2007/0251258 A1 Nov. 1, 2007

(30) Foreign Application Priority Data

Jul. 23, 2004 (JP) ..... 2004-216348

(51) Int. Cl.
*F25D 17/02* (2006.01)
*F25D 17/00* (2006.01)
*C09K 5/04* (2006.01)

(52) U.S. Cl. ..... 62/434; 62/114; 62/333

(58) Field of Classification Search ..... 62/390, 62/434, 3.7, 66, 373, 371, 420–425; 99/276, 99/277, 277.1, 278; 426/11, 231, 592, 524
See application file for complete search history.

(56) References Cited

U.S. PATENT DOCUMENTS 3,869,870 A * 3/1975 Kuehner ..... 62/114
4,291,757 A 9/1981 Redden
5,372,011 A * 12/1994 O'Neal ..... 62/93
6,062,035 A * 5/2000 Ueno ..... 62/324.1
6,148,626 A 11/2000 Iwamoto
6,332,335 B1 12/2001 Kajimoto et al.

FOREIGN PATENT DOCUMENTS

CH 475 533 7/1969
DE 197 48 985 A1 5/1999

(Continued)

*Primary Examiner*—Frantz F Jules
*Assistant Examiner*—Cassey Bauer
(74) *Attorney, Agent, or Firm*—Drinker Biddle & Reath LLP

(57) ABSTRACT

A cooling system (10) comprises a first (40) and a second (50) cold storage tank, a first refrigerator (41) cooling water in the first cold storage tank (40), a first thermal load (92) disposed in a first circulating passage (43) extending from the lower to the upper part of the first cold storage (40), a second thermal load (93) warmer than the first thermal load (92) disposed in a second circulating passage (44*a*) also extending from the lower to the upper part of the first cold storage tank, a second cold storage tank (50) disposed in the second circulating passage, a second refrigerator (51) cooling water fed from the upper part of the second cold storage (50), wherein a cooling output temperature of the second refrigerator (51) is set to be higher than that of the first refrigerator (41).

5 Claims, 5 Drawing Sheets

FOREIGN PATENT DOCUMENTS

| | | | |
|---|---|---|---|
| DE | 19748985 | * | 5/1999 |
| DE | 199 33 534 A1 | | 2/2000 |
| DE | 203 18 865 U1 | | 2/2004 |
| EP | 0 510 888 A2 | | 10/1992 |
| JP | 11 014222 A | | 1/1999 |
| JP | 2002 206845 | | 7/2002 |

* cited by examiner

COOLING SYSTEM

CROSS REFERENCE TO RELATED APPLICATIONS

This application is a National Stage of International Application No. PCT/JP2005/013429 filed Jul. 14, 2005, and which claims benefit of Japanese Patent Application No. 2004-216348 filed Jul. 23, 2004, which is incorporated by reference herein in its entirety.

TECHNICAL FIELD

The present invention relates to a cooling system, particularly to one used in the production of a beverage.

BACKGROUND ART

In the brewing of beer, which is one kind of alcoholic beverage, there are four processes; a preparation process, a fermentation process (main fermentation process), a storage process (subsequent fermentation process) and a filtration process. In the preparation process, wort is formed by boiling hot water containing malt and filtering the same to remove impurities contained therein. Next, the wort is fermented in the fermentation process by adding yeast thereto after being cooled. Then, the fermented malt beverage immediately after the fermentation; i.e., young beer is matured in the storage process, and the matured fermented malt beverage such as beer thus obtained is filtered in the filtration process. Finally, the filtered beer is filled in cans or others by a filler (not shown), after which the cans or others are tightly sealed by a seamer and shipped as products.

In this regard, in each of the above-mentioned four processes, a cooling treatment is carried out, to a predetermined temperature, depending on the respective process. In the preparation process, of the four processes, the cooling treatment is carried out with relatively low temperature water such as well water until the malt juice temperature reaches approximately 20° C. Since a lower temperature is required, in some of the above processes, than the cooling temperature attained by using well water in the preparation process, however, a cooling system achieving such a low temperature must be used. Note that the cooling temperature in these processes becomes lower in the order of the preparation process, the fermentation process, the storage process and the filtration process.

FIG. 5 schematically illustrates a cooling system based on the prior art. As shown in FIG. 5, the cooling system 100 based on the prior art includes a heat-storage tank 200 filled with a coolant, such as brine which is a glycol-type antifreeze. The heat-storage tank 200 is cooled, through a passage 220, by a refrigerator group 210. As illustrated, in the prior art cooling system 100, three circulating passages 110, 120 and 130 arranged generally parallel to each other are connected to the heat-storage tank 200. These circulating passages 110, 120 and 130 are connected to three loads to be cooled, that is, a low thermal load 113, a medium thermal load 123 and a high thermal load 133, respectively, and heat is exchanged therewith. The temperature of the load to be cooled becomes higher in the order of the low thermal load 113, the medium thermal load 123 and the high thermal load 133, wherein the low thermal load 113 corresponds to the storage process and the filtration process during the brewing beer, the medium thermal load 123 to the fermentation process, and the high thermal load 133 to the preparation process, respectively.

In the cooling system 100 shown in FIG. 5, the brine in the heat-storage tank 200 is cooled by the refrigerator group 210 to a temperature lower than that necessary for the low thermal load 113. Then, the cooled brine circulates through the circulating passages 110, 120 and 130 by pumps not shown, whereby the low thermal load 113, the medium thermal load 123 and the high thermal load 133 can be properly cooled, respectively, while the brine is passing through the circulating passages 110, 120 and 130.

However, as all of the low thermal load 113, the medium thermal load 123 and the high thermal load 133 are cooled by means of a single refrigerator group 210 in the cooling system 100 shown in FIG. 5, it is needed to cool the brine in the heat-storage tank 200 to a temperature lower than that necessary for cooling the low thermal load 113. Thus, the medium thermal load 123 and the high thermal load 133 are cooled with the brine cooled at a lower temperature than required. In other words, in the prior art cooling system 100, there is a large energy loss in the cooling operation because the refrigerator group 210 suitable for generating the low temperature necessary for the low thermal load 113 is also used for cooling the medium thermal load 123 and the high thermal load 133. Also, in the prior art cooling system 100, as a single refrigerator group 210 is used for cooling all of the low thermal load 113, the medium thermal load 123 and the high thermal load 133, a long time and much energy are required until the brine has been cooled to a predetermined temperature, which largely increase the running cost of the refrigerator group 210. Furthermore, the brine having a relatively high viscosity is circulated by a pump through all the circulating passages 110, 120 and 130, which results in the large energy loss.

In this regard, when refreshing beverages other than alcoholic beverage, such as oolong tea drink, green tea drink, carbonated drink or coffee drink are produced, cooling treatments may be carried out in some processes. Of these cooling treatments, there are cases in which well water is used as a coolant. In most of these cooling treatments, a temperature corresponding to those of the medium thermal load 123 or the high thermal load 133 when the beer is brewed, is necessary. Accordingly, a cooling system similar to that described above is necessary in the process for producing beverages other than an alcoholic beverage. In this regard, while the above-mentioned temperature necessary for cooling of the low thermal load 113 is lower than 0° C., it is impossible to cool beverages other than an alcoholic beverage to such a low temperature because of freezing, whereby the low thermal load 113 does not need to be taken into account.

FIG. 6 schematically illustrates a cooling system used for the production of beverages other than an alcoholic beverage. The cooling system 300 shown in FIG. 6 is provided with a heat-storage tank 400 filled with water. This heat-storage tank 300 is cooled, by means of a refrigerator group 410, through a passage 420. Also, as illustrated, in the prior art cooling system 300, two circulating passages 320 and 330 arranged generally parallel to each other are connected to the heat-storage tank 400. The circulating passage 320 is connected to an medium thermal load 323, while the circulating passage 330 is connected to a high thermal load 333. The cooling temperature required for the medium thermal load 323 and the high thermal load 333 becomes higher in this order.

According to the cooling system 300 shown in FIG. 6, water in the heat-storage tank 400 is cooled by the refrigerator group 410 to a temperature lower than that necessary for the medium thermal load 323. Then, the cooled water circulates through the circulating passages 320 and 330 by means of a pump not shown. Accordingly, it is possible to properly cool the medium thermal load 323 by the circulation of water through the circulating passage 320, and to properly cool the high thermal load 333 by the circulation of water through the circulating passage 330. Note that each of the medium thermal load 323 and the high thermal load 333 in the cooling system 300 shown in FIG. 6 is different, in temperature, in accordance with kinds of beverages produced by this system. While only two kinds of thermal loads; that is, the medium thermal load 323 and the high thermal load 333; are shown in the cooling system 300 in FIG. 6, there may be a case wherein the kinds of the thermal loads increase or decrease; i.e., either one of the medium thermal load 323 and the high thermal load 333 may be eliminated.

As is well known, an alcoholic beverage, for example beer, is produced in a beer factory exclusive designed therefor, and general beverage containing no alcohol, such as oolong tea drink, green tea drink, carbonated drink or coffee drink is produced in a beverage-producing factory other than a beer factory. Recently, it has been contemplated to centralize a beer factory and another beverage-producing factory in the same site. In such a case, it is expected to have such advantages that beer and the other beverage could be stored in the same storehouse and the same devices could be used for the both in part of the production process such as an inspection process.

When the above-mentioned cooling system 100 or 300 is commonly adopted for the productions of beer and the non-alcoholic beverage, however, there may be the following disadvantages:

Assuming that the cooling system 100 used for brewage of beer is also used simultaneously in the process for producing a non-alcoholic beverage, as there is no low thermal load when producing general beverage containing no alcohol, only a capacity necessary for cooling the medium thermal load 123 and the high thermal load 133 increases more than that needed for brewing beer. However, as the cooling system 100 is designed to cool all of the low thermal load 113, the medium thermal load 123 and the high thermal load 133 by a single refrigerator group 210, it is necessary to increase a capacity for cooling the low thermal load 113 for the purpose of increasing capacities for cooling the medium thermal load 123 and the high thermal load 133, even if it is unnecessary to increase the capacity for cooling the low thermal load, whereby the size of the refrigerator group 210 must be larger. A temperature necessary for cooling the low thermal load 113 is lower than 0° C., and brine is used for achieving such a low temperature. Accordingly, the increase in capacity for cooling the low thermal load 113 in the production line for non-alcoholic drink in which no low thermal load exists, results in a large energy loss.

On the other hand, if the cooling system 300 used for the production of non-alcoholic beverage is also used simultaneously for the brewage of beer the cooling system 300 cannot be used for brewing beer because there is no means for cooling the low thermal load 113 in the cooling system 300. For the above-mentioned reasons, the development of a novel cooling system commonly usable for brewing beer and the production of the other beverage has been desired.

The present invention has been made under such circumstances, and an object thereof is to provide an advantageous cooling system capable of reducing its energy loss, particularly in the cooling treatment during brewing beer and the production of another beverage.

DISCLOSURE OF THE INVENTION

According to a first aspect of the present invention, for achieving the above-mentioned object, a cooling system is provided and comprises a first heat-storage tank for storing water, a first refrigerator connected to said first heat-storage tank, for storing heat in the water in said first heat-storage tank, a first circulating passage circularly extending from the lower part of said first heat-storage tank to the upper part of said first heat-storage tank, wherein a first thermal load is disposed therein, a second circulating passage circularly extending from the lower part of said first heat-storage tank to the upper part of said first heat-storage tank, wherein a second thermal load thermally higher than said first thermal load is disposed therein, a second heat-storage tank disposed in said second circulating passage at a position between said second thermal load and said first heat-storage tank, wherein said second circulating passage supplies water to the upper part of the second heat-storage tank and supplies the water from the upper part of said second heat-storage tank to the upper part of said first heat-storage tank, and a second refrigerator disposed in said second circulating passage at a position between said second heat-storage tank and said first heat-storage tank, for storing heat in water fed from the upper part of said second heat-storage tank, wherein a cooling output temperature of said second refrigerator is set to be higher than that of said first refrigerator.

That is, according to the first aspect, it is usually possible to reduce the running cost.

According to a second aspect, a cooling system is provided and comprises a first heat-storage tank for storing water, a first refrigerator connected to said first heat-storage tank, for storing heat in the water in said first heat-storage tank, a first circulating passage circularly extending from the lower part of said first heat-storage tank to the upper part of said first heat-storage tank, wherein a first thermal load is disposed therein, a second circulating passage circularly extending from the lower part of said first heat-storage tank to the upper part of said first heat-storage tank, wherein a second thermal load thermally higher than said first thermal load is disposed therein, a second heat-storage tank disposed in said second circulating passage at a position between said second thermal load and said first heat-storage tank, wherein said second circulating passage supplies water to the upper part of the second heat-storage tank and supplies the water from the upper part of said second heat-storage tank to the upper part of said first heat-storage tank, and a second refrigerator group disposed in said second circulating passage at a position between said second heat-storage tank and said first heat-storage tank, for storing heat in water fed from the upper part of said second heat-storage tank, wherein a cooling output temperature of part or all of refrigerators constituting said second refrigerator group are set to be higher than that of said first refrigerator.

According to the second aspect, it is usually possible to reduce the running cost. Also, when the requirement for the first thermal load, i.e., the medium thermal load is high, the cooling output temperature of some of the refrigerators constituting the second refrigerator group is made to be equal to that of the first refrigerator. Further, when the requirement for the second thermal load; i.e., the high temperature load is high, it is possible to solve the problem by increasing a ratio of refrigerators in the second refrigerator group higher in cooling output temperature than the first refrigerator. Particularly, when beer and other beverages of which the requirement for the medium and high temperature loads varies due to the seasonal fluctuation of demand are produced in the same factory, the second aspect is advantageous.

According to a third aspect on the basis of the first aspect, further comprises a supply passage for supplying water from the upper part of said first heat-storage tank to the lower part of said second heat-storage tank.

That is, in the third aspect, it is usually possible to reduce the running cost. Also, the second heat-storage tank which is a high temperature heat-storage tank is physically connected to the first heat-storage tank through the supply passage for supplying water from the upper part of the first heat-storage tank which is a medium temperature heat-storage tank to the lower part of the second heat-storage tank. As the temperature of the lower part of the second heat-storage tank is approximately equal to that of the upper part of the first heat-storage tank, it is possible to use both the second and first heat-storage tanks as a single integral heat-storage tank. Accordingly, in the third aspect, when the requirement for the first thermal load, which is a medium thermal load, is high, it is possible to address to such a requirement by using the above-mentioned supply passage as well as by equalizing the cooling output temperature of the second refrigerator to that of the first refrigerator.

According to a fourth aspect on the basis of the second aspect, further comprises a supply passage for supplying water from the upper part of said first heat-storage tank to the lower part of said second heat-storage tank.

That is, according to the fourth aspect, it is usually possible to reduce the running cost. Also, through the supply passage for supplying water from the upper part of the first heat-storage tank; i.e., the medium temperature heat-storage tank to the lower part of the second heat-storage tank; i.e., the high temperature heat-storage tank, the second heat-storage tank is physically connected to the first heat-storage tank. As the temperature of the lower part of the second heat-storage tank is approximately equal to that of the upper part of the first heat-storage tank, it is possible to use both the second and first heat-storage tanks as a single integral heat-storage tank. Accordingly, in the fourth aspect, when the requirement for the first thermal load; i.e., the medium thermal load, is high, or when the requirement for the second thermal load; i.e., the high thermal load, is high, it is possible to address to such a requirement by using the above-mentioned supply passage as well as by equalizing the cooling output temperature of part or all of the second refrigerator to that of the first refrigerator.

According to a fifth aspect on the basis of one of the second to fourth aspects, further comprises a sub-circulating passage circularly extending from the upper part of said first heat-storage tank to the lower part of said first heat-storage tank, wherein said second refrigerator group is disposed in said sub-circulating passage.

That is, in the fifth aspect, it is possible to use the second refrigerator group; i.e., the high temperature refrigerator group as the first heat-storage tank; i.e., the medium temperature heat-storage tank through the sub-circulating passage. Accordingly, in the fifth aspect, it is possible to address such a requirement by equalizing the cooling output temperature of part or all of the second refrigerator with that of the first refrigerator. Also, even if the first refrigerator is inoperative, it is possible to use the second refrigerator group as a backup of the first refrigerator by similarly setting the second refrigerator group.

According to a sixth aspect on the basis of one of the first to fifth aspects, further comprises a brine heat-storage tank for storing brine, a brine refrigerator connected to said brine heat-storage tank, for storing heat in the brine of the brine heat-storage tank, and a third circulating passage circularly extending from the lower part of said brine heat-storage tank to the upper part of said brine heat-storage tank, and having a third thermal load disposed therein, wherein said third thermal load is lower than said first thermal load.

According to a seventh aspect on the basis of the sixth aspect, further comprises a heat exchanger for exchanging heat between said brine heat-storage tank and said first heat-storage tank.

That is, in the sixth and seventh aspects, it is possible to transfer the cold heat of the brine heat-storage tank to the first heat-storage tank; i.e., the medium temperature heat-storage tank by the heat exchanger. Accordingly, when the requirement for the medium thermal load is high or the first refrigerator group is inoperative, it is possible to address such problems by using the brine heat-storage tank as a backup.

According to an eighth aspect, a cooling system is provided and comprises a first heat-storage tank for storing water, a first refrigerator connected to said first heat-storage tank, for storing heat in the water in said first heat-storage tank, a brine heat-storage tank for storing brine, a brine refrigerator connected to said brine heat-storage tank, for storing heat in the brine of the brine heat-storage tank, and a third circulating passage circularly extending from the lower part of said brine heat-storage tank to the upper part of said brine heat-storage tank, and having a third thermal load disposed therein, wherein said third thermal load is thermally lower than said first thermal load.

According to a ninth aspect on the basis of the eighth aspect, further comprises a heat exchanger for exchanging heat between said brine heat-storage tank and said first heat-storage tank.

That is, in the eighth and ninth aspects, it is possible to transfer cold heat in the brine heat-storage tank to the first heat-storage tank; i.e., the medium temperature heat-storage tank and, thus, when the requirement for the medium thermal load is high or the first refrigerator group is inoperative, it is possible to address such problems by using the brine heat-storage tank as a backup.

According to each aspect, the effect is achievable in that the running cost is reduced it is possible to deal therewith.

Further, according to the second aspect, when the requirement for the first and second thermal loads is high, it is possible to deal therewith.

Further, according to the third aspect, when the requirement for the first thermal load is high, it is possible to deal therewith by using the above-mentioned supply passage as well as by equalizing the cooling output temperature of the second refrigerator to that of the first refrigerator.

Further, according to the fourth aspect, when the requirement for the first or second thermal load is high, it is possible to deal therewith by using the above-mentioned supply passage as well as by equalizing the cooling output temperature of part or all the second refrigerator group to that of the first refrigerator.

Further, according to the fifth aspect, it is possible to deal therewith the second refrigerator group is usable as a backup for the first refrigerator.

Further, according to the sixth and seventh aspects, when the requirement for the medium thermal load is high or the first refrigerator group is inoperative, it is possible to deal therewith it is possible to address such problems by using the brine heat-storage tank as a backup.

Further, according to the eighth and ninth aspects, when the requirement for the medium thermal load is high or the first refrigerator group is inoperative, it is possible to deal therewith it is possible to address such problems by using the brine heat-storage tank as a backup.

These and other objects, features and advantages of the present invention will be more apparent in light of the detailed description of exemplary embodiments thereof as illustrated by the attached drawings.

BEST MODE FOR CARRYING OUT THE INVENTION

Figure 1:
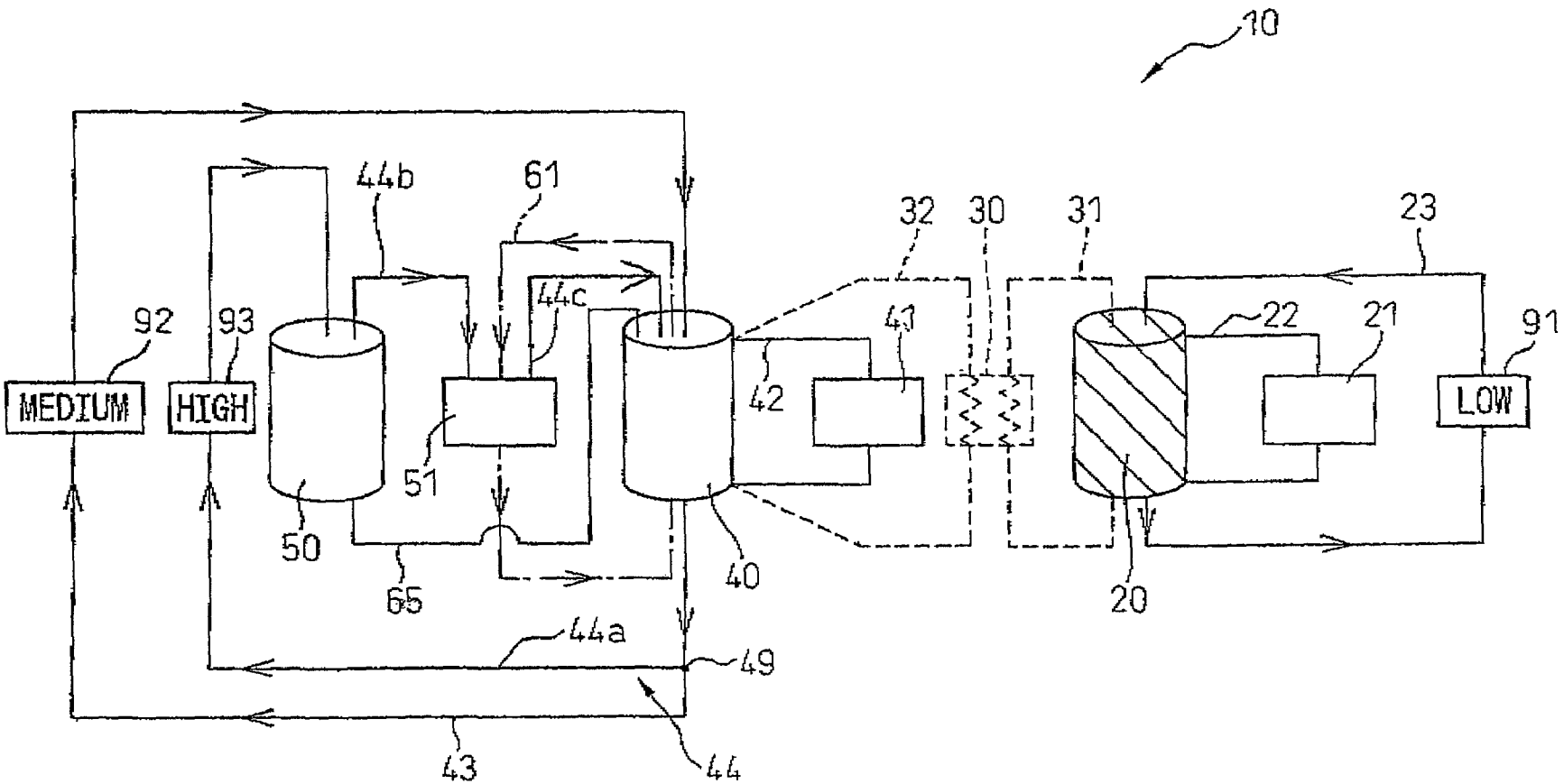
FIG. 1 is a schematic illustration of a cooling system according to one embodiment of the present invention.

Preferred embodiments of the present invention will be described below with reference to the attached drawings wherein the same reference numerals are used for indicating the same or similar elements, and the scale may be suitably changed to clarifying the illustration.

FIG. 1 is a schematic illustration of a cooling system according to one embodiment of the present invention. The cooling system 10 is used for suitably cooling a low thermal load 91 shown on the right side in FIG. 1 and an medium thermal load 92 and a high thermal load 93 shown on a left side of FIG. 1.

A load temperature to be cooled becomes lower in the order of the high thermal load 93, the medium thermal load 92 and the low thermal load 91. As stated above, during the brewage of beer, there are processes needing the cooling treatment by means of the cooling system; a preparation process, a fermentation process, a storage process and a filtration process. As the temperature necessary for cooling malt juice in the preparation process is about 12° C. to about 8° C., the malt juice after being cooled in the preparation process by well water as described before is the high thermal load 93 in the cooling system 10. As the temperature necessary for maturing young beer in the fermentation process is about 10° C. to about 6° C., the young beer to be matured in the fermentation process is the medium thermal load 92 in the cooling system 10. Further, as the temperature necessary for cooling the beer in the storage process and the filtration process is about 0° C. to the freezing temperature of beer, the beer in the storage process and the filtration process is the low thermal load 91.

Although not described in detail, when beverages other than beer, such as coffee drink or oolong tea drink are produced, there are processes needing the cooling treatment by means of the cooling system 10, wherein the aimed temperature is about 10° C. to about 8° C. Accordingly, the beverage to be cooled during the production of refreshment beverage is mainly the medium thermal load 92 and the high thermal load 93.

As shown in FIG. 1, the cooling system 10 according to the present invention includes a low temperature heat-storage tank 20 used for cooling the low thermal load 91. The low temperature heat-storage tank 20 is filled with coolant, for example, brine which is a glycol-type antifreeze. As illustrated, the low temperature heat-storage tank 20 is connected to a low temperature refrigerator group 21 through a passage 22. The low temperature heat-storage tank 20 is also connected to the low thermal load 91 through a circulating passage 23. The brine in the low temperature heat-storage tank 20 is cooled by the low temperature refrigerator group 21. Heat from the low thermal load 91 is transferred to the brine when circulating through the circulating passage 23. The brine in the low temperature heat-storage tank 20 cooled by the low temperature refrigerator group 21 is at a predetermined temperature, for example, in a range from about −6° C. to about −3° C. suitable for cooling the low thermal load 91 from about 0° C. to the freezing temperature of beer.

The cooling system 10 shown in FIG. 1 further includes a medium heat-storage tank 40 used for cooling the medium thermal load 92. The medium temperature heat-storage tank 40 is filled with water. In the same manner as in the low temperature heat-storage tank 20, the medium heat-storage tank 40 is connected to a medium temperature refrigerator group 41 through a passage 42. As shown in FIG. 1, a circulating passage 43 extends from a lower part of the medium temperature heat-storage tank 40 and is connected to an upper part of the medium temperature heat-storage tank 40, wherein the medium thermal load 92 is provided midway in the circulating passage 43. Water in the medium temperature heat-storage tank 40 is cooled by the medium temperature refrigerator group 41 and heat from the medium thermal load 92 is transferred to the water when it runs through the circulating passage 43. The water in the medium temperature heat-storage tank 40 cooled by the medium temperature refrigerator group 41 is at a predetermined temperature, for example, 5° C. which is suitable for cooling the medium thermal load 92 at a temperature in a range from about 10° C. to about 6° C.

Another circulating passage 44 is connected to the medium heat-storage tank 40. As shown in FIG. 1, the circulating passage 44 includes passages 44*a*, 44*b* and 44*c*. In FIG. 1, part of the passage 44*a* extending from the lower part of the medium temperature heat-storage tank 40 to a junction 49 is identical to the circulating passage 43, and the other part forward of the junction 49 is shown as a separate passage. As illustrated, the high thermal load 93 is provided in the passage 44*a* downstream from the junction 49. Heat of the high thermal load 93 in the passage 44*a* is transferred to the heat of the water cooled by the refrigerator group 41. The passage 44*a* is further connected to the upper part of the high temperature heat-storage tank 50 provided in the cooling system 10. As water flows from the medium temperature heat-storage tank 40 into the passage 44*a* which is part of the circulating passage 44, the high temperature heat-storage tank 50 is also filled with water. In addition, as is apparent from FIG. 1, the passage 44*b* which is part of the circulating passage 44 extending from the upper part of the high temperature heat-storage tank 50 is connected to a high temperature refrigerator group 51. Also, as shown in FIG. 1, the passage 44*c* which is part of the circulating passage 44 extending from the high temperature refrigerator group 51 is connected to the upper part of the medium temperature heat-storage tank 40.

Figure 2:
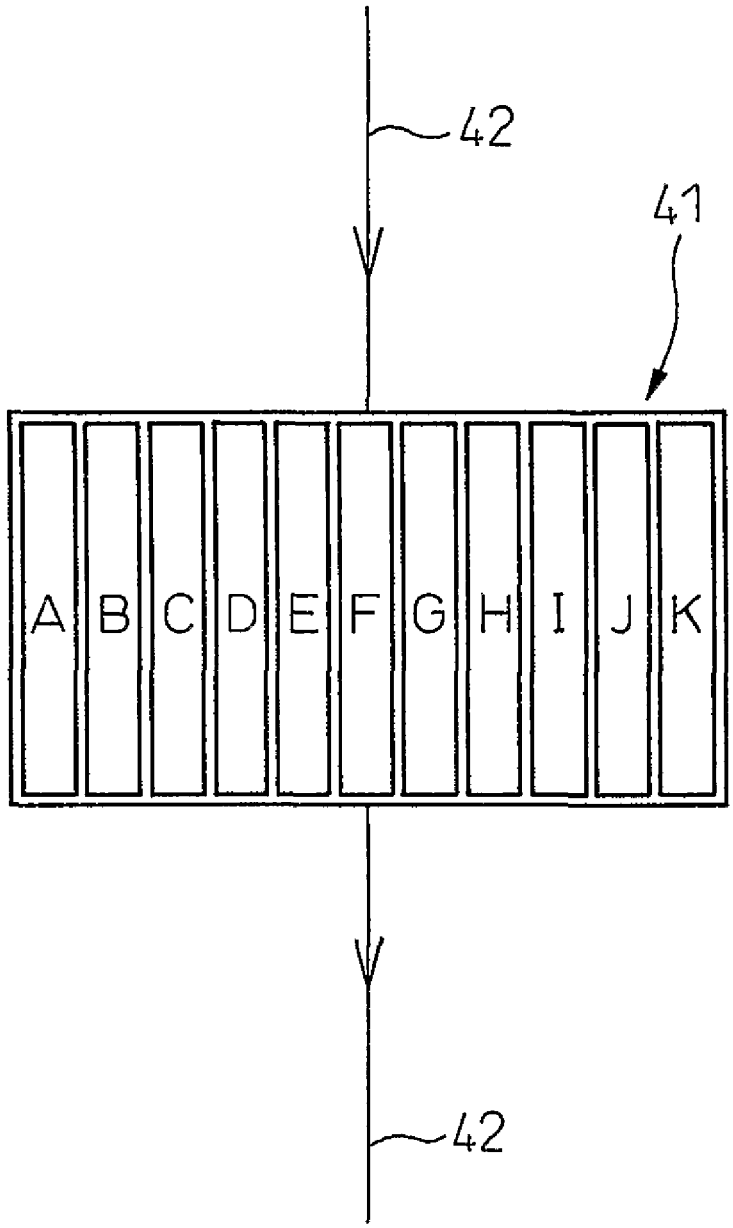
FIG. 2 is an enlarged schematic illustration of a refrigerator group for an medium thermal load.

FIG. 2 is an enlarged schematic illustration of a refrigerator group for a medium thermal load. The medium temperature refrigerator group 41 shown in FIG. 2 consists of a plurality of refrigerators A to K. All the refrigerators A to K do not always operate while the cooling system 10 is working but some of the refrigerators A to K may be used in accordance with the thermal loads. When the required cooling level for the thermal load relating to the medium temperature refrigerator group 41; that is, the medium thermal load 92, is relatively low, in other words, when a capacity required for the medium thermal load 92 is relatively small, part of the refrigerators in the group, for example, the refrigerators A to C are solely used. On the other hand, when the required cooling level for the medium thermal load 92 is relatively high; that is, when a capacity necessary for the medium thermal load 92 is relatively large, it is possible to use all the refrigerators A to K. Alternatively, the medium temperature refrigerator group 41 may consist of a single refrigerator.

Individual refrigerators consisting of the high temperature refrigerator group 51, the medium temperature refrigerator group 41 and the low temperature refrigerator group 21, respectively, are designed to have the same cooling output temperature. In this regard, the cooling output temperature stands for a temperature of a coolant such as water or brine after passing through such a refrigerator. That is, the respective refrigerators consisting of the high temperature refrigerator group 51 and the medium temperature refrigerator group 41 are capable of suitably setting various conditions such as the expansion of coolant in the refrigerator or others so that the cooling output temperature identical to that of the individual refrigerator in the low temperature refrigerator group 21 may be obtained. According to the present invention, the medium temperature refrigerator group 41 is designed so that the cooling output temperature of one or more refrigerators constituting the medium temperature refrigerator group 41 is higher than that of the respective refrigerator constituting the low temperature refrigerator group 21. Thereby, it is possible to reduce the running cost in comparison with a case in which only the low temperature refrigerator group 21 is used. On the other hand, the high temperature refrigerator group 51 is designed so that the cooling output temperature of one or more refrigerators constituting the high temperature refrigerator group 51 is higher than that of the respective refrigerator constituting the medium temperature refrigerator group 41. Thereby, it is possible to further reduce the running cost in comparison with a case in which the only low temperature refrigerator group 21 and the medium temperature refrigerator group 41 are used. In this regard, although not illustrated in the drawing, either the high temperature refrigerator group 51 or the low temperature refrigerator group 21 is formed from a plurality of refrigerators A to K in the same manner as in the medium temperature refrigerator group 41, but may consist of a single refrigerator.

Returning again to FIG. 1, a sub-circulating passage 61 extending from the upper part of the medium temperature heat-storage tank 40 is connected to the lower part of the medium temperature heat-storage tank 40 through the high temperature refrigerator group 51.

Further, as shown in FIG. 1, another circulating passage 31 is provided in the low temperature heat-storage tank 20, and a further circulating passage 32 is provided in the medium temperature heat-storage tank 40. As apparent from FIG. 1, these circulating passages 31, 32 are thermally connected to each other via a heat exchanger 30.

In FIG. 1, there is also a supply passage 65 connecting the upper part of the medium temperature heat-storage tank 40 to the lower part of the high temperature heat-storage tank 50. Note that the brine in the low temperature heat-storage tank 20 and the water both in the medium temperature heat-storage tank 40 and the high temperature heat-storage tank 50 are suitably fed in the directions indicated by arrows in FIG. 1 by means of pumps (not shown). In this case, as the highly viscous brine circulates only through the circulating passage 23, a pump used for the low temperature heat-storage tank 20 may be smaller in capacity than that of the prior art.

During the operation of the cooling system illustrated, the above-mentioned malt juice or young beer are connected to the cooling system 10 as the low thermal load 91, the medium thermal load 92 or the high thermal load 93. Further, the other beverages are connected to the cooling system as the medium thermal load 92 or the high thermal load. Then, the low temperature refrigerator group 21, the medium temperature refrigerator group 41 and the high temperature refrigerator group 51 are respectively driven, the brine in the low temperature heat-storage tank 20 is cooled to about −5° C., and the water in the medium temperature heat-storage tank 40 is cooled to about 5° C. and high temperature heat-storage tank 50 is cooled within a range from about 10 to about 13° C.

The brine having a temperature of about −5° C. in the low temperature heat-storage tank 20 flows into the circulating passage 23 from the lower part of the low temperature heat-storage tank 20. While flowing the circulating passage 23, the brine cools the low thermal load 91 from about 0° C. to a beer freezing temperature. After passing the low thermal load 91, the temperature of the brine rises to about −2° C. and flows into the upper part of the low temperature heat-storage tank 20 through the circulating passage 23. In the low temperature heat-storage tank 20, the brine is cooled again by the low temperature refrigerator group 21.

Similarly, the water in the medium temperature tank 40 having a temperature at about 5° C. flows into the circulating passage 43 from the lower part of the medium temperature heat-storage tank 40. This water cools the medium thermal load 92 from about 10° C. to about 6° C., and conversely becomes warm to a temperature within a range from about 10° C. to about 13° C., which then flows into the upper part of the medium temperature heat-storage tank 40 through the circulating passage 43. Similarly, water in the medium temperature heat-storage tank 40 is cooled by the medium temperature refrigerator group 41.

The water having a temperature of about 5° C. output from the medium temperature heat-storage tank 40 flows into the passage 44*a* which is part of the circulating passage 44 at the junction 49. Then, the water cools the high thermal load 93 in the passage 44*a* to about 10° C. Thereby, the water itself becomes warm to about 20° C. and flows into the upper part of the high temperature heat-storage tank 50. Next, the water flows into the high temperature refrigerator group 51 from the upper part of the high temperature heat-storage tank 50 through the passage 44*b*, and is cooled in the high temperature refrigerator group 51 to a temperature in a range from about 10° C. to about 13° C., after which the water flows into the upper part of the medium temperature heat-storage tank 40 through the passage 44*c*.

Figure 3A:
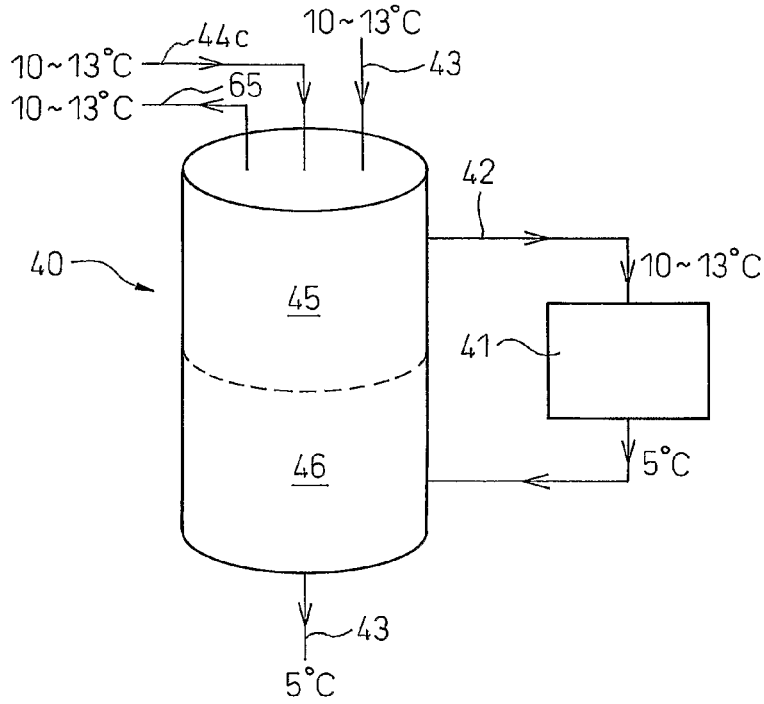
FIG. 3*a* is an enlarged schematic illustration of a heat-storage tank for the medium thermal load.

FIG. 3*a* is an enlarged schematic illustration of the medium temperature heat-storage tank. As described before, while the temperature of the water discharged from the lower part of the medium temperature heat-storage tank 40 is about 5° C., the water temperature becomes about 10° C. to about 13° C. when it is again flows into the upper part of the medium temperature heat-storage tank 40 through the circulating passage 43, because the water temperature rises when it cools the medium thermal load 92. Also, water discharged from the high temperature heat-storage tank 50 is cooled by the high temperature refrigerator group 51 within a range from about 10° C. to about 13° C., and flows into the upper part of the medium heat-storage tank 40 through the passage 44*c*. On the other hand, water existing in the upper part of the medium temperature heat-storage tank 40, having a temperature in a range from about 10° C. to about 13° C. is cooled by the medium temperature refrigerator group 41 to about 5° C., and returns to the lower part of the medium temperature heat-storage tank 40. As is well known, high-temperature fluid moves upward and low-temperature fluid moves downward. Accordingly, the water in the medium temperature heat-storage tank 40 has a tendency to form layers of different temperatures. In other words, as shown in FIG. 3*a*, there are an upper layer 45 having a temperature in a range from about 10° C. to about 13° C. and a lower layer 46 having a temperature of about 5° C. While a plurality of thermally distributed layers are actually formed between the upper layer 45 and the lower layer 46, such thermally distributed layers are not shown in the drawing and an explanation thereof will not be given to simplify the matter.

Figure 3B:
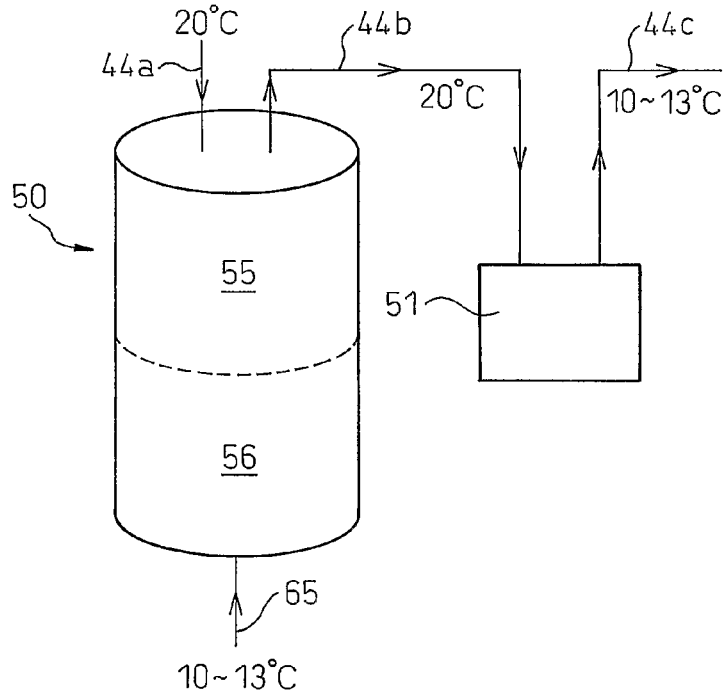
FIG. 3*b* is an enlarged schematic illustration of a heat-storage tank for the high thermal load.

FIG. 3*b* is an enlarged schematic illustration of the high temperature heat-storage tank. The temperature of the water in the passage 44*a* is about 5° C. as described before, but as it rises while the high thermal load 93 is cooled, the water temperature changes to about 20° C. when the water flows into the upper part of the high temperature heat-storage tank 50. This water is fed to the high temperature refrigerator group 51 through the passage 44*b*, and flows into the upper part of the medium temperature heat-storage tank 40 through the passage 44*c* after being cooled to a temperature in a range from about 10° C. to about 13° C. in the high temperature refrigerator group 51 (see FIG. 3*a*). Through the supply passage 65 shown in FIG. 1, the water in the upper part of the medium temperature heat-storage tank 40 (having a temperature in a range from about 10° C. to about 13° C.) is fed to the lower part of the high temperature heat-storage tank 50. Accordingly, in the same manner as in the medium temperature heat-storage tank 40, the water forms two layers different of temperature in the high temperature heat-storage tank 50; an upper layer 55 of about 20° C. and a lower layer in a range from about 10° C. to about 13° C. as shown in FIG. 3*b*. Also in this case, while a plurality of thermally distributed layers are actually formed between the upper layer 55 and the lower layer 56, such thermally distributed layers are not shown in the drawing and an explanation thereof will not be given to simplify the matter.

Figure 4:
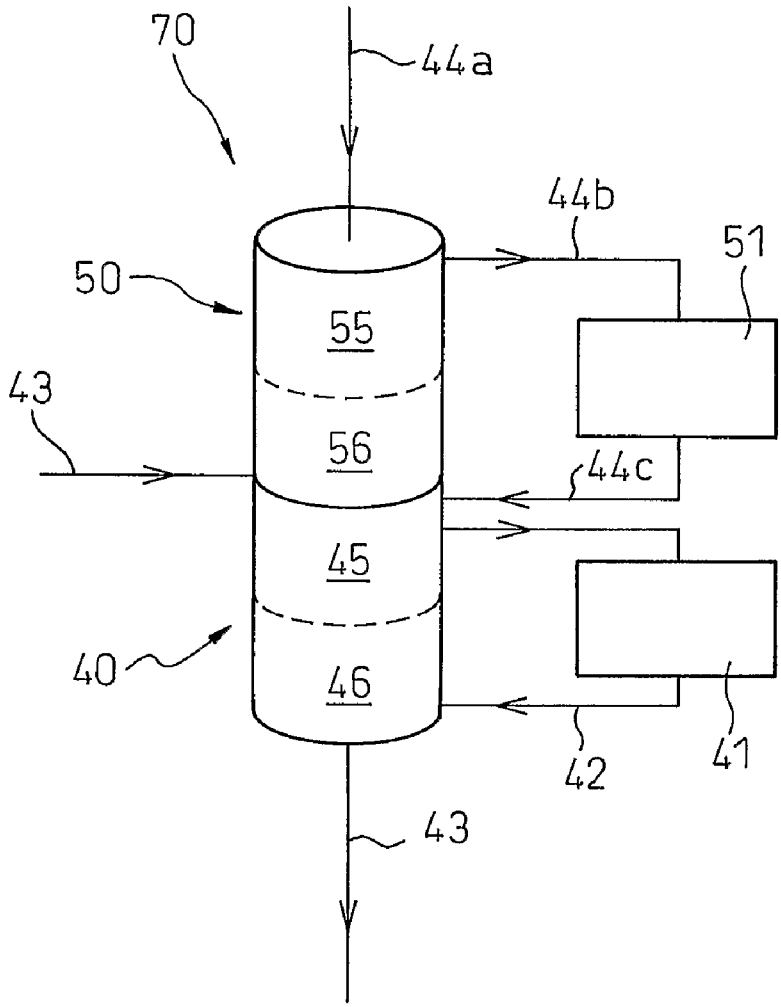
FIG. 4 is a conceptual illustration of the inventive cooling system, showing part thereof in an enlarged manner.
Figure 5:
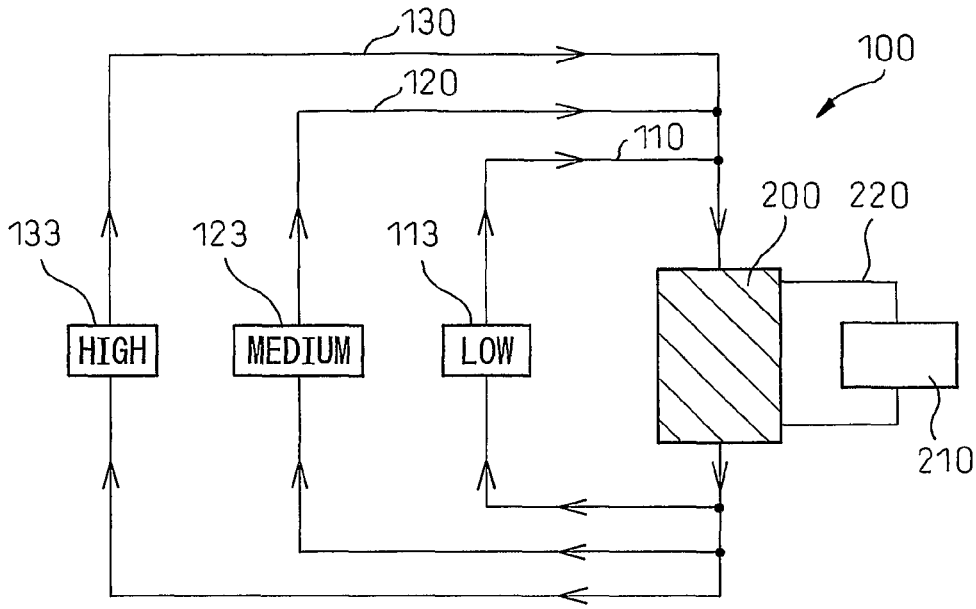
FIG. 5 is a schematic illustration of a cooling system based on the prior art.
Figure 6:
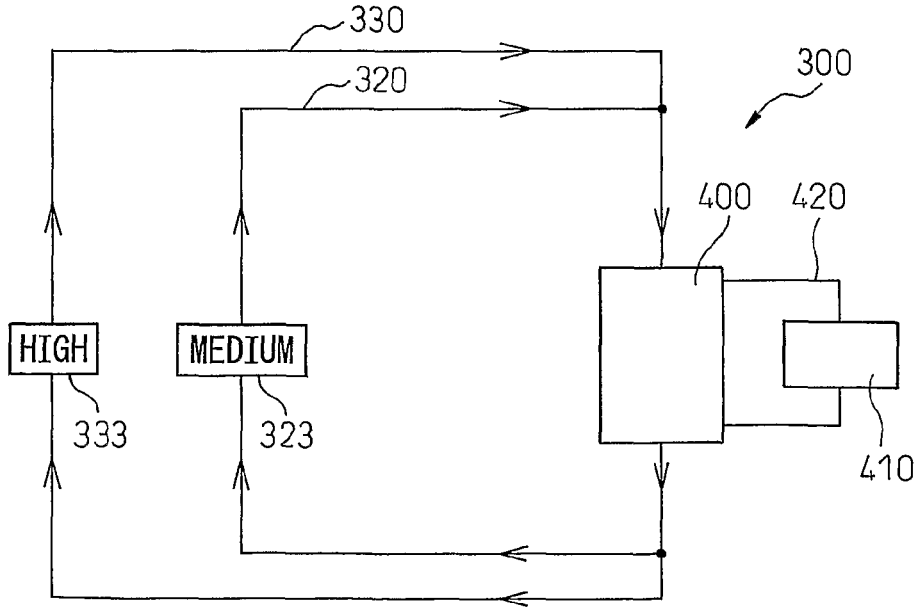
FIG. 6 is a schematic illustration of a cooling system used for the production of non-alcoholic drink.

As described above, according to the present invention, the lower part of the high temperature heat-storage tank 50 and upper part of the medium temperature heat-storage tank 40 are connected to each other through the supply passage 65. In addition, the temperature of the lower layer 56 in the high temperature heat-storage tank 50 is approximately equal to that of the upper layer 45 in the medium temperature heat-storage tank 40 as described before. That is, it can be interpreted that the high temperature heat-storage tank 50 is placed above the medium temperature heat-storage tank 50 so that both the heat-storage tanks 40, 50 are simply integrated with each other. In other words, as shown in FIG. 4 which is a conceptual illustration of the inventive cooling system, showing part thereof in an enlarged manner, the high temperature heat-storage tank 50 and the medium temperature heat-storage tank 40 are a single heat-storage tank 70 as they are coupled together by the supply passage 65 (not shown in FIG. 4).

In this case, it is interpreted that the high temperature refrigerator group 51 is connected to the upper layer 55 of the high temperature heat-storage tank 50 through the passage 44*b*, and is connected to the upper layer 45 of the medium heat-storage tank 40 through the passage 44C. Further, it is interpreted that the medium temperature refrigerator group 41 is connected to the upper layer 45 and the lower layer 46 of the medium temperature heat-storage tank 40 through the passage 42.

Note the interior of the single heat-storage tank 70. As the temperature of the lower layer 56 in the high temperature heat-storage tank 50 is approximately equal to that of the upper layer 45 in the medium temperature heat-storage tank 40, these layers 56 and 45 can be deemed to be a single integrated layer. Thus, it could be interpreted that, within the single heat-storage layer 70, there are three layers; the upper layer 55 having a temperature at about 20° C., a layer consisting of the lower layer 56 and the upper layer 45 having a temperature at about 10° C., and the lower layer 46 having a temperature at about 5° C.

In this regard, a cooling capacity for beer is higher in the summer season but becomes lower in the winter season. A cooling capacity for a refreshing drink such as a coffee drink also increases in the summer season and reduces in the winter season.

However, when the refreshing beverages are produced, there is no requirement for cooling the low thermal load 91, and a level of the requirement for cooling the medium thermal load 92 and the high thermal load 93 varies as items to be produced (such as coffee drinks, carbonated drinks, oolong tea drinks or green tea drinks) are different. Thus, if a ratio of the produced items varies, the level of the cooling requirement for the medium thermal load 92 or the high thermal load 93 is also considerably changed. Accordingly, in the factory for producing both beer and a refreshing beverage, it is desired that the cooling system is adjustable corresponding to the cooling requirement for the low thermal load 91, the medium thermal load 92 and the high thermal load 93 which is considerably variable in accordance with seasons or produced items in comparison with factories exclusively producing beer or refreshing beverages.

According to the present invention, by adopting the above-mentioned supply passage 65, a single heat-storage tank 70 is simply formed. As described above, the high temperature refrigerator group 51 in the cooling system 10 usually has more refrigerators outputting a high cooling temperature than those in the medium refrigerator group 41. However, as individual refrigerators constituting the high temperature refrigerator group 51, the medium temperature refrigerator group 41 and the low temperature refrigerator group 21 are designed to have the same cooling output temperature, it is possible to adjust the cooling output temperature of some refrigerators in the high temperature refrigerator group 51 to be equal to that of the individual refrigerators in the medium temperature refrigerator group 41.

For example, when the requirement for cooling the high thermal load 93 is high, it is possible to address to this requirement by setting the cooling output temperature of the individual refrigerators in the high temperature refrigerator group 51 to be higher than that of the individual refrigerators in the medium temperature refrigerator group 41 so that the layer including the lower layer 46 and upper layer 55 grow in size. Similarly, when the requirement for the medium thermal load 92 is high, it is possible to address to this requirement by setting the cooling output temperature of some refrigerators in the high temperature refrigerator group 51 on the side closer to the medium temperature heat-storage tank 40 to be equal to that of the individual refrigerators in the medium temperature refrigerator group 41 so that the lower layer 46 and upper layer 55 grow in size. Accordingly, in a factory producing both beer and refreshing beverages, in which the cooling requirements for the medium thermal load 92 and the high thermal load 93 change with the fluctuation of demand caused by the seasonal variation, the cooling system 10 having the common supply passage 65 can easily address to such requirement.

When the requirement for the medium thermal load 92 is high, the cooling output temperature of some refrigerators in the high temperature refrigerator group 51 disposed on the side closer to the medium heat-storage tank 40 is set to be equal to that of the individual refrigerators in the medium temperature refrigerator group 41, and water (having a temperature in a range from about 10° C. to about 13° C.) of the upper layer 45 in the medium temperature heat-storage tank 40 is supplied through the sub-circulating passage 61 to the refrigerators in the high temperature refrigerator group 51 set to have the same cooling output temperature as that of the individual refrigerators in the medium temperature refrigerator group 41 to cool the water at about 5° C., which is then returned through the sub-circulating passage 61 to the lower layer 46 in the medium temperature heat-storage tank 40. Thereby, according to the cooling system 10 of the present invention, even if the cooling requirement for the medium thermal load 92 is high, it is possible to easily deal therewith. Similarly, even if the medium temperature refrigerator group 41 is inoperative, the high temperature refrigerator group 51 is usable as a backup of the medium temperature refrigerator group 41 by using the sub-circulating passage 61.

In addition, according to the present invention, heat of the medium temperature heat-storage tank 40 can be transferred to the heat of the low temperature heat-storage tank 20 through the circulating passage 31, the heat exchanger 30 and the circulating passage 32. As the temperature of brine in the low temperature heat-storage tank 20 is lower than the temperature of water in the medium temperature heat-storage tank 40 as described before, it is possible to complement the cooling operation of the medium temperature heat-storage tank 40 by means of the medium temperature refrigerator group 41 by transferring the cool heat of the low temperature heat-storage tank 20 to the medium temperature heat-storage tank 40. Thus, according to the present cooling system 10, even if the cooling requirement for the medium thermal load 92 is high or if the medium temperature refrigerator group 41 is inoperative, the cold heat of the brine in the low temperature heat-storage tank 20 is used as a backup of the medium temperature refrigerator group 41 to solve such problems. Needless to say, some of the above-mentioned elements may be suitably combined to modify the above embodiments, which is also within a spirit of the present invention.

Although the present invention has been shown and described with exemplary embodiments thereof, it should be understood, by those skilled in the art, that the foregoing and various other changes, omissions and additions may be made therein and thereto without departing from the spirit and the scope of the present invention.

The invention claimed is:

1. A cooling system for the production of beverages comprising a first heat-storage tank for storing water, a first refrigerator connected to said first heat-storage tank, for storing heat in the water in said first heat-storage tank, a first circulating passage circularly extending from the lower part of said first heat-storage tank to the upper part of said first heat-storage tank, wherein a first thermal load is disposed therein, a second circulating passage circularly extending from the lower part of said first heat-storage tank to the upper part of said first heat-storage tank, wherein a second thermal load thermally higher than said first thermal load is disposed therein, a second heat-storage tank disposed in said second circulating passage at a position between said second thermal load and said first heat-storage tank, wherein said second circulating passage supplies water to the upper part of the second heat-storage tank and supplies the water from the upper part of said second heat-storage tank to the upper part of said first heat-storage tank, and a second refrigerator group, which includes a plurality of refrigerators, disposed in said second circulating passage at a position between said second heat-storage tank and said first heat-storage tank, for storing heat in water fed from the upper part of said second heat-storage tank, wherein a cooling output temperature of part or all of refrigerators constituting said second refrigerator group are set to be higher than that of said first refrigerator, wherein when the requirement for the first thermal load is high, a first number of the refrigerators in the second refrigerator group are used, and when the requirement for the second thermal load is high, a second number, which is bigger than the first number, of the refrigerators in the second refrigerator group are used, and;

a sub-circulating passage circularly extending from the upper part of said first heat-storage tank to the lower part of said first heat-storage tank, wherein said second refrigerator group is disposed in said sub-circulating passage.

2. A cooling system as defined by claim 1, further comprising a supply passage for supplying water from the upper part of said first heat-storage tank to the lower part of said second heat-storage tank.

3. A cooling system as defined by claim 1, further comprising a supply passage for supplying water from the upper part of said first heat-storage tank to the lower part of said second heat-storage tank.

4. A cooling system as defined by claim 1, further comprising a brine heat-storage tank for storing brine, a brine refrigerator connected to said brine heat-storage tank, for storing heat in the brine in the brine heat-storage tank, and a third circulating passage circularly extending from the lower part of said brine heat-storage tank to the upper part of said brine heat-storage tank, and having a third thermal load disposed therein, wherein said third thermal load is thermally lower than said first thermal load.

5. A cooling system as defined by claim 4, further comprising a heat exchanger for exchanging heat between said brine heat-storage tank and said first heat-storage tank.

* * * * *

UNITED STATES PATENT AND TRADEMARK OFFICE

CERTIFICATE OF CORRECTION

PATENT NO. : 7,836,721 B2
APPLICATION NO. : 11/632650
DATED : November 23, 2010
INVENTOR(S) : Yoshinori Nishiwaki et al.

It is certified that error appears in the above-identified patent and that said Letters Patent is hereby corrected as shown below:

In Section (73) "Assignees" on the Title page of the above-identified patent, add --Mayekawa MFG. Co., Ltd., Osaka-shi, Osaka (JP)--.

Signed and Sealed this
Seventeenth Day of May, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,836,721 B2
APPLICATION NO. : 11/632650
DATED : November 23, 2010
INVENTOR(S) : Yoshinori Nishiwaki et al.

It is certified that error appears in the above-identified patent and that said Letters Patent is hereby corrected as shown below:

Title Page, Section (73) "Assignee" Mayekawa MFG. Co., Ltd. on the Certificate of Correction dated May 17, 2011 of the above-identified patent, change "Osaka-shi, Osaka (JP)" to --Tokyo (JP)--

Signed and Sealed this
Eighth Day of November, 2011

David J. Kappos

David J. Kappos
*Director of the United States Patent and Trademark Office*